US012522258B2

(12) United States Patent
Schnaibel

(10) Patent No.: US 12,522,258 B2
(45) Date of Patent: Jan. 13, 2026

(54) HEATED EMERGENCY RELEASE

(71) Applicant: Bombardier Transportation GmbH, Berlin (DE)

(72) Inventor: Jörg Schnaibel, Berlin (DE)

(73) Assignee: Bombardier Transportation GmbH, Berlin (DE)

( * ) Notice: Subject to any disclaimer, the term of this patent is extended or adjusted under 35 U.S.C. 154(b) by 775 days.

(21) Appl. No.: 17/770,351

(22) PCT Filed: Oct. 20, 2020

(86) PCT No.: PCT/EP2020/079497
§ 371 (c)(1),
(2) Date: Apr. 20, 2022

(87) PCT Pub. No.: WO2021/078738
PCT Pub. Date: Apr. 29, 2021

(65) Prior Publication Data

US 2022/0379932 A1 Dec. 1, 2022

(30) Foreign Application Priority Data

Oct. 21, 2019 (DE) ..... 102019128384.1

(51) Int. Cl.
*B61D 19/02* (2006.01)

(52) U.S. Cl.
CPC ..... *B61D 19/02* (2013.01)

(58) Field of Classification Search
CPC ..... B61D 19/02; B61D 19/026
See application file for complete search history.

(56) References Cited

U.S. PATENT DOCUMENTS

| | | | | |
|---|---|---|---|---|
| 7,775,481 | B2 * | 8/2010 | Jopp | E05C 9/04 219/466.1 |
| 11,898,392 | B2 * | 2/2024 | Rieboldt | E05B 63/22 |
| 2005/0145442 | A1 * | 7/2005 | Cocher | B66B 13/24 187/333 |
| 2005/0236522 | A1 * | 10/2005 | Jopp | E05B 17/0016 244/118.1 |
| 2006/0225966 | A1 * | 10/2006 | Cocher | B66B 13/24 187/314 |
| 2022/0379932 | A1 * | 12/2022 | Schnaibel | B61D 19/02 |

(Continued)

FOREIGN PATENT DOCUMENTS

| | | | | |
|---|---|---|---|---|
| CN | 108330920 A | | 7/2018 | |
| CN | 115573629 A | * | 1/2023 | |
| CN | 116080722 A | * | 5/2023 | B61C 17/00 |

(Continued)

OTHER PUBLICATIONS

Mobility Networks Logistics, Instruction Sheet for Railway Vehicles, Diesel Car, Typ 81H: BR 620 & 621 /Typ 54H: BR 622, Deutsche Bahn AG, May 2013.

(Continued)

*Primary Examiner* — Jason C Smith
(74) *Attorney, Agent, or Firm* — The Webb Law Firm

(57) ABSTRACT

An external emergency unlocking device of a door. The emergency unlocking device includes an emergency actuating device which can be protected against icing by a heating element. A corresponding passenger transport means, in particular a rail vehicle, is also disclosed.

13 Claims, 2 Drawing Sheets

(56) References Cited

U.S. PATENT DOCUMENTS

2025/0030716 A1* 1/2025 Cross ..... H04L 63/1441

FOREIGN PATENT DOCUMENTS

| | | | | | |
|---|---|---|---|---|---|
| CN | 109296271 | B | * | 10/2023 | ..... E05B 77/02 |
| DE | 2012201 | | | 10/1971 | |
| DE | 2656495 | A1 | | 6/1978 | |
| DE | 19737666 | A1 | | 1/1999 | |
| DE | 20307840 | U1 | | 8/2003 | |
| DE | 202004006526 | U1 | * | 10/2005 | ..... E05B 79/20 |
| DE | 202009016637 | U1 | | 6/2010 | |
| DE | 102009043723 | A1 | | 4/2011 | |
| EP | 1589168 | A1 | | 10/2005 | |
| EP | 1479864 | B1 | * | 9/2006 | ..... B61D 19/02 |
| ES | 2286546 | T3 | * | 12/2007 | ..... B66B 13/12 |
| FR | 3057496 | A1 | | 4/2018 | |
| GB | 1597175 | | | 9/1981 | |
| JP | 2000108897 | A | * | 4/2000 | |
| JP | 2019074280 | A | | 5/2019 | |
| KR | 100963482 | B1 | | 6/2010 | |
| KR | 1020130031039 | A | | 3/2013 | |

OTHER PUBLICATIONS

Commission Regulation (EU) No. 1302/2014, concerning a technical specification for interoperability relating to the rolling stock—locomotives and passenger rolling stock' subsystem of the rail system in the European Union, Official Journal of the European Union, Nov. 18, 2014, pp. 223, 285, 287-288, 360-361.

* cited by examiner

HEATED EMERGENCY RELEASE

CROSS-REFERENCE TO RELATED APPLICATIONS

This application is the United States national phase of International Application No. PCT/EP2020/079497 filed Oct. 20, 2020, and claims priority to German Patent Application No. 10 2019 128 384.1 filed Oct. 21, 2019, the disclosures of which are hereby incorporated by reference in their entirety.

BACKGROUND OF THE INVENTION

Field of the Invention

The invention relates to an external emergency unlocking device for a door of a passenger transport means, in particular of a rail vehicle, which comprises an emergency actuating device.

Description of Related Art

At present, an external emergency release for passenger transport means is usually designed without, and more rarely with, a cover or flap. Such a cover or flap serves the purpose of protecting the emergency actuating device, for example a lever, from misuse or unintentional actuation on the one hand and also from dirt or icing in order to ensure its function.

Under wintry conditions, such as those common in climatically colder regions such as north-eastern Europe, Scandinavia or Russia and Canada in the period from November to March, massive ice build-up can easily occur.

A door arrangement for a rail vehicle is known from DE 10 2009 043 723 A1, in which a heating device with a heat-emitting heating element is designed as a component of a door leaf. In particular, the heating element is arranged close to the door gap. This ensures operability even in very cold climatic regions.

SUMMARY OF THE INVENTION

It is therefore an object of the present invention to provide an external emergency unlocking device of the type mentioned above, which reliably and effectively ensures operability.

According to the invention, this object is solved with an emergency unlocking device described herein. Further embodiments, modifications and improvements result from the following description and the appended claims.

According to a first teaching of the present invention, the previously derived and presented object is solved in that the emergency actuating device comprises an emergency unlocking device and at least one correspondingly associated heating element, by means of which icing-up of the emergency unlocking device and/or the emergency actuating device is prevented, thereby ensuring functioning of the emergency unlocking device and/or the emergency actuating device.

By providing a heating element—several heating elements can of course also be provided—which protects the emergency actuating device from icing up, very low temperatures and thus ice build-up can be counteracted by simple means—in this case, use can also be made of tubes through which a heating medium flows or of heating rods, heating wires, heating foils and/or heating mechanisms designed in a different way. By heating the area in and around the emergency actuating device, the formation of ice is either greatly reduced or completely prevented and thus the mechanical emergency release by actuating the emergency actuating device is functioning. Radiant heat also makes it easier to actuate the mechanical components of the release mechanism, which might have become frozen due to ice build-up, which reduces the mechanical stresses on the mechanism and has a positive effect on its service life and functionality.

According to an advantageous embodiment, the heating element(s) may be integrated into the emergency actuating device, i.e. located inside the emergency actuating device, or inside one or more recesses, as well as attached to or on the emergency actuating device. Similarly, it is possible to place the heating element close to, e.g. adjacent to, the emergency actuating device.

According to one embodiment, the emergency actuating device is based on a mechanical opening principle, in particular in order to be able to bypass malfunctioning electronics or sensors. Such an emergency actuating device allows the door to be opened independently of other systems of the passenger transport means. Furthermore, the emergency actuating device can be configured in such a way that existing closing mechanisms of the door can be opened purely mechanically and without the opening-effective actuation by electrical/electronic operating mechanisms.

This is the first time that icing, which can occur after certain standstill times or also after longer journeys in the area of the emergency release, can be avoided, causing a time delay and thus serious problems, for example in the rescue of passengers.

According to a further preferred embodiment, the outer emergency unlocking device comprises a cover flap. This prevents the entry of dirt and basically prevents icing due to low temperatures. In combination with heating, icing can thus be effectively counteracted. If heating is provided by a heating element on or in the emergency actuating device, the cover flap is also protected against icing, depending on the heating power.

In particular, in an embodiment with a cover flap, it is advantageous if the cover flap itself can be heated. This means that a heating element can be integrated into the cover flap, placed in the direct vicinity or close to the cover flap, or located on it. Placement on the counterpart of the flap is also conceivable. It is also advantageous to place the flap where the heat radiates to hinges or connecting elements or where the heat is located at the edges or overlapping areas of the flap. It is thus ensured that the areas of the cover flap that are in contact with the opposite side—such as on the vehicle body—when opened do not experience icing.

According to a further embodiment of the invention, both the cover flap and the emergency actuating device each comprise at least one heating element. Similarly, it is possible for a common, cohesive, larger heating element to heat the cover flap and the emergency actuating device together.

Ideally, the heating element heats electrically. Furthermore, it would also be possible for heating to be provided by a tube (or several tubes) through which a heating medium flows, or by heating rods, heating wires, heating foils, etc. Waste heat from other components of the transport means can also be used. Likewise, convection heating can also be provided and thus, for example, a heated air flow can ensure non-icing or ice freeing.

In the course of a preferred embodiment of the invention, it is disclosed that the at least one heating element (3) is configured as a linear heating element (3). Such linear heating elements are common, for example, in rail vehicle construction and are also used for heating entry bar. They therefore represent available and inexpensive elements.

According to a further useful further development of the invention, the emergency actuating device is recessed in a hollow. This hollow or recess is located in or on the vehicle body of rail vehicles, for example. In this way, a flat structure or area on the vehicle body is obtained with the appropriate design with cover flap. Of course, another shape is also conceivable, so that the flap protrudes and is thus more easily or additionally recognisable from the outside. Furthermore, such a hollow also protects the emergency actuating device from external damage and thus prevents the emergency actuating device from being torn off.

According to a preferred embodiment of the invention, the heating element(s) are installed from inside behind the hollow. If the hollow is designed as a separate part, this is attached to the vehicle body. In this case, the heating element(s) may advantageously be located internally behind the attachment of the hollow. Such a positioning of the heating elements has the advantage that malfunctions of the heating elements can be remedied from the inside or the heating elements can be replaced from the inside. If, for example, the heating is not activated and the flap is therefore frozen, access to the heating elements is still guaranteed.

According to another useful further development of the invention, the at least one heating element is attached by means of bonding. Thus, a reliable heat transfer is ensured. The adhesive chosen for this purpose should be a material with a high heat transfer coefficient. Examples would be silicone adhesives or epoxy resin adhesives. By adding zinc oxide, silver, copper, graphite and/or aluminium powder, a higher thermal conductivity is also given. Adhesives based on thermoplastics are also possible. Ceramic fillers are another possible option. Welding of the heating elements is of course also possible. Furthermore, reversible fastening or attachment of the heating elements by insertion into a rail system is possible. Click or clip systems or by means of rivets or fastening by means of screws are also possible. Such reversible fastening also has the advantage that replacement is easier. In principle, any type of mechanical fastening or materially bonded fastening is possible.

In the course of a preferred embodiment of the invention, it is disclosed that a control, regulation and/or monitoring of the heating element or heating elements can be monitored by a thermal sensor. With suitable regulation and control electronics, the heating element can be regulated and controlled. Thus, the heating element(s) can be switched off in time, for example at temperatures above freezing point, and switched on if temperatures below freezing point prevail. This can save energy and also increase the service life of the heating elements. An automatic on/off switch is also possible. A higher or lower heating power is also possible.

Ideally, the external emergency unlocking device comprises a monitoring system which controls and regulates the heating element(s) via the air conditioning system. The aforementioned automatic operation can also be coupled via an automatic air conditioning system. In this case, various gradations are possible and can be regulated from the switched-off state to reduced heating or also increased heating power. Sensors can also be used to create a predefined temperature range in cooperation with the automatic air conditioning system. This adjustment ensures safe operation and can also save energy. Thus, the temperature can be flexibly regulated. For example, it is possible for the heating elements to bring the support area of the flap or the area around the emergency actuating device to a temperature above the freezing point and to maintain this for a period of time, for example until the end of the operation of a rail vehicle journey.

According to a preferred embodiment of the invention, the control and regulation device and/or also the heating element(s) operates with an autonomous energy supply, in particular current supply. Thus, a safe function can be guaranteed at any time. Putting into operation via various power circuits is also conceivable. In any case, an emergency unlocking mechanism, such as the external emergency unlocking device, should have redundant power supply options.

In particular, it is conceivable that the emergency unlocking device can be connected to means of an autonomous power supply, in particular to an electrical power supply, and/or comprises such means and is connected thereto. For example, the emergency unlocking device may comprise an electrical energy storage device and/or chemical energy storage device for providing thermal energy, which, at least upon actuation of the emergency unlocking device or the emergency unlocking mechanism, delivers electrical energy to the heating element or thermal energy to the emergency unlocking mechanism. In the latter case, the heating element and the means for storing thermal energy can be integrated using the chemical storage principle. That is, the chemical energy storage means for providing thermal energy and the heating element may be of integral or one-piece design. For example, the chemical heating element may be activated by mechanical action, for example similar to a glow stick, such that the heat provided by the heating element can release an icing of the emergency release mechanism.

Additionally or alternatively, the emergency unlocking device may be configured such that the autonomous energy storage device and/or the heating element is/are activated precisely by actuation of the emergency unlocking mechanism. In particular, this can lead to an emergency opening of the door as follows: First actuation of the emergency release mechanism serves to activate; after a certain period of time to release the icing, the emergency release mechanism is actuated a second time, whereby the door is released and can be opened.

In particular, combinations of the discussed solutions according to the invention with each other as well as with principles generally known to the skilled person are also conceivable.

BRIEF DESCRIPTION OF THE DRAWINGS

The accompanying drawings illustrate embodiments and, together with the description, serve to explain the principles of the invention. The elements of the drawings are relative to each other and not necessarily to scale. Identical reference signs here denote correspondingly similar parts.

DESCRIPTION OF THE INVENTION

Although specific embodiments have been illustrated and described herein, it is within the scope of the present invention to suitably modify the embodiments shown without departing from the scope of the present invention.

Figure 1:
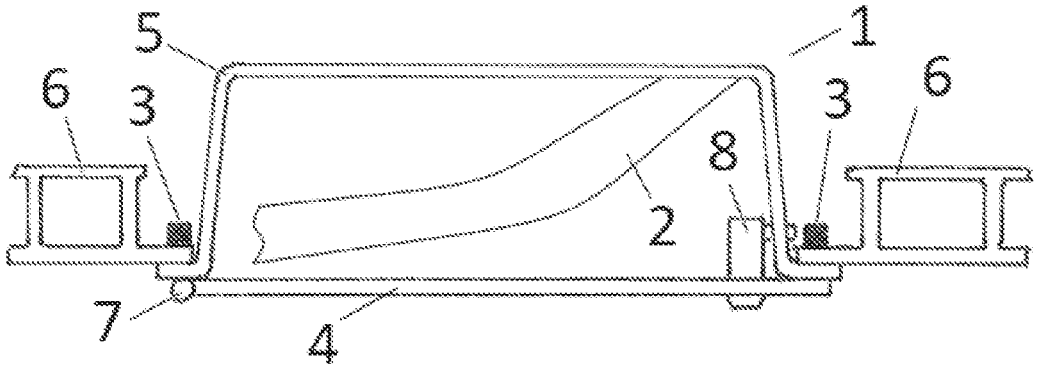
FIG. 1 shows a sectional view of an external emergency unlocking device integrated into a vehicle body.

FIG. 1 shows an external emergency unlocking device (1) comprising a hollow (5) applied to a vehicle body (6) from the outside, such that an indentation, i.e. the hollow (5), is located in the vehicle body (6). The emergency actuating device (2), which represents the actuating device of the emergency release, is present in this recess. By activation, i.e. by turning, pushing or pulling, a door is mechanically emergency unlocked and can thus be opened easily. In specific embodiments, a direct door opening by actuation is directly possible. A cover flap (4) is fitted above the hollow (5) and is connected to the hollow (4) by a hinge (7). The hinge (7) can of course also be located on the vehicle body (6). The closing mechanism (8) allows the cover flap (4) to be locked. The heating elements (3) shown here are located outside the hollow (5) and are installed from the inside behind the fastening of the hollow (5) for the emergency release. This means that the heating elements (3) can be reached from the outside—relative to the hollow (5)—in the event of a malfunction, or they could also be installed in such a way that repair is possible via the inside of the car. As shown schematically, the heating elements (3) in this design are located close to the hinge (7) or the closing mechanism (8), as these elements are particularly at risk with regard to inoperability—i.e. non-openability of the cover flap (4)—in the event of ice build-up.

Figure 2A:
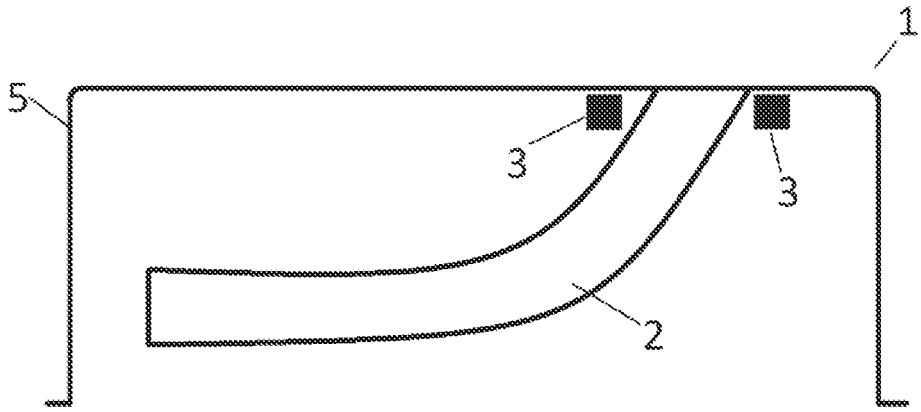
FIGS. 2*a* to 2*c* show—in schematic representation—a sectional view of an external emergency unlocking device with (FIGS. 2*b* and 2*c*) and without (FIG. 2*a*) cover flap and different embodiments with regard to the placement of heating elements.

FIG. 2*a* shows an example of an external emergency unlocking device (1) without cover flap. The emergency actuating device (2) located in a hollow (5) is kept functional, i.e. protected against ice build-up, by heating elements (3) being located close to the actuating mechanism. The mechanism contained therein is thus protected against ice build-up.

Figure 2B:
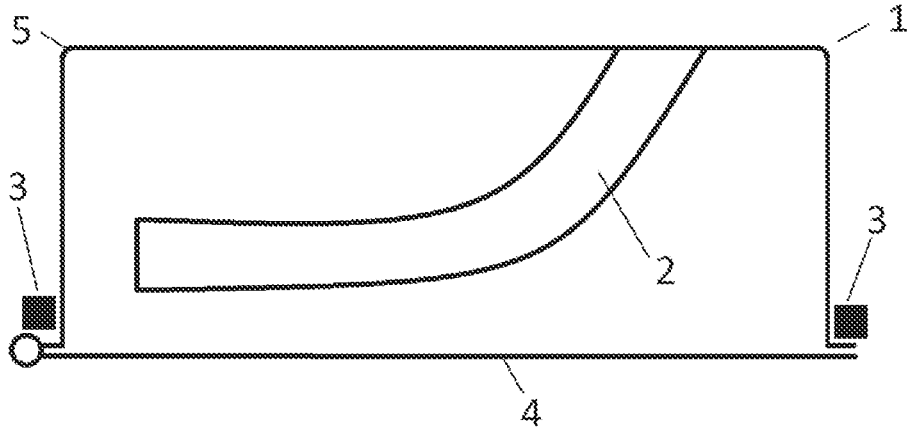

FIG. 2*b* shows an external emergency unlocking device (1) which comprises a cover flap (4). The resulting protection against environmental influences on the emergency actuating device (2) involves the risk of the cover flap (4) freezing over, which is eliminated by heating elements (3) being located—at least partially—above the opening areas of the cover flap (4). In the sectional view of FIG. 2*b*, the heating elements (3) are close to the hinge (7) and closing mechanism (8), cf. FIG. 1.

Figure 2C:
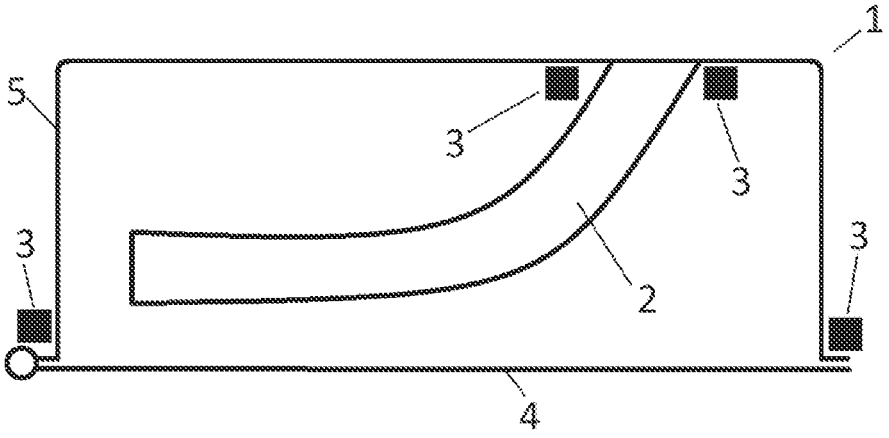

FIG. 2 *c* combines the advantages of the embodiments in FIGS. 2*a* and 2*b*. This protects both the cover flap (4) and the emergency actuating device (2) from icing up by means of heating elements (3).

The invention claimed is:

1. An external emergency unlocking device of a door of a passenger transport vehicle, comprising an emergency actuating device and at least one heating element, wherein the at least one heating element is arranged on at least one of the emergency unlocking device and the emergency actuating device such that the emergency actuating device is protected against icing by the heating element, wherein the emergency actuating device is embedded in a hollow of a vehicle body, and wherein the hollow and the emergency actuating device are covered by a flap attached to the vehicle body.

2. The external emergency unlocking device according to claim 1, wherein the emergency actuating device does not serve as a standard opening actuating device for the door.

3. The external emergency unlocking device according to claim 1, wherein the cover flap comprises the at least one heating element, or wherein the cover flap and the emergency actuating device comprise the at least one heating element.

4. The external emergency unlocking device according to claim 1, wherein the at least one heating element is at least one of an electrically heating and a linear heating element.

5. The external emergency unlocking device according to claim 1, wherein the at least one heating element is installed at a rear side of the hollow facing the passenger transport vehicle and from inside behind the hollow.

6. The external emergency unlocking device according to claim 1, wherein the at least one heating element is mounted by means of bonding.

7. The external emergency unlocking device according to claim 6, wherein the bonding is carried out by means of a thermally conductive adhesive.

8. The external emergency unlocking device according to claim 6, wherein the thermally conductive adhesive is a two-component epoxy- or silicone-based adhesive.

9. The external emergency unlocking device according to claim 1, wherein at least one of control, regulation, and monitoring of the at least one heating element is monitored by a thermal sensor and regulated by control electronics.

10. The external emergency unlocking device according to claim 1, wherein at least one of control, regulation, and monitoring of the at least one heating element takes place via an air conditioning system.

11. The external emergency unlocking device according to claim 1, wherein at least one of a control and regulation device and the at least one heating element are operated by an autonomous power supply.

12. A door assembly for a passenger transport vehicle, the door assembly, comprising a door and a standard opening actuating device for opening and closing the door during intended operation of the passenger transport vehicle and an external emergency unlocking device according to claim 1.

13. The door assembly according to claim 12, further comprising a closing mechanism for locking the door in a door frame of the passenger transport vehicle, wherein the emergency actuating device is configured such that the closing mechanism can be opened purely mechanically and without opening-effective actuation of electrical/electronic action mechanisms.

* * * * *